US006454024B1

(12) United States Patent
Nackerud

(10) Patent No.: US 6,454,024 B1
(45) Date of Patent: Sep. 24, 2002

(54) REPLACEABLE DRILL BIT ASSEMBLY

(76) Inventor: Alan L. Nackerud, 9957 Titan Park Cir., Littleton, CO (US) 80125

( * ) Notice: Subject to any disclaimer, the term of this patent is extended or adjusted under 35 U.S.C. 154(b) by 0 days.

(21) Appl. No.: 09/699,172

(22) Filed: Oct. 27, 2000

(51) Int. Cl.[7] ..... E21B 10/66
(52) U.S. Cl. ..... 175/57; 175/259; 175/265; 175/292
(58) Field of Search ..... 175/57, 265, 273, 175/290, 292, 284, 258, 259, 263

(56) References Cited

U.S. PATENT DOCUMENTS

| | | | | |
|---|---|---|---|---|
| 1,044,598 A | * | 11/1912 | Sullivan | |
| 1,585,540 A | * | 5/1926 | Dougherty | |
| 2,203,998 A | | 7/1940 | O'Brady | 255/76 |
| 2,814,463 A | | 11/1957 | Kammerer, Jr. | 255/76 |
| 2,893,693 A | * | 7/1959 | Clark | |
| 3,196,961 A | | 7/1965 | Kammerer | 175/267 |
| 3,552,509 A | | 1/1971 | Brown | 175/258 |
| 3,554,304 A | | 1/1971 | Link et al. | 175/259 |
| 3,656,564 A | | 4/1972 | Brown | 175/228 |
| 3,684,041 A | | 8/1972 | Kammerer, Jr. et al. | 175/267 |
| 5,148,875 A | * | 9/1992 | Karlsson et al. | 175/62 |
| 5,271,472 A | | 12/1993 | Leturno | 175/107 |
| 5,494,121 A | * | 2/1996 | Nackerud | 175/263 |

OTHER PUBLICATIONS

History of Oil Well Drilling (Brantley, J.E.) (1971) pp. 1114–1120; 1160–1167; 1171; 1175–1176; 1180–1185.

* cited by examiner

*Primary Examiner*—William Neuder
(74) *Attorney, Agent, or Firm*—John E. Reilly

(57) ABSTRACT

In a retrievable drill bit assembly, a standard drill pipe or casing pipe has a sub threaded into its lower end which forms a seat coupling for upper rounded pivotal ends of a pair of drill bits which are pivotally mounted between a pair of lift plates. The drill bits have blades extending from the pivotal ends with hardened cutter elements in staggered relation along or adjacent to the leading edge and a fluid passage leading into a series of nozzles in the blades which together with the rotational force of the drill pipe and the frictional force of the blades on the material to be bored will cause the blades to assume and maintain a mutually perpendicular position. The blades or cutters can be retrieved by a retrieval apparatus for the purpose of removal and replacement with a new set of blades.

29 Claims, 7 Drawing Sheets

REPLACEABLE DRILL BIT ASSEMBLY p BACKGROUND AND FIELD OF INVENTION

This invention relates to rotary drill bits and more particularly relates to a novel and improved drill bit assembly which can be retrievably mounted at the lower end of a conventional drill string and has pivotal blade arms which can be expanded radially outwardly by fluid pressure combined with the rotational force of the drill string and the frictional force of the drill string weight on the material being bored.

Numerous types of retrievable drill bit assemblies have been devised for downhole or earth boring operations but in the past have been costly to manufacture and operate, time-consuming and not capable of performing different types of boring operations, such as, milling operations. Representative patents are U.S. Letters Patent Nos. 2,203,998 to D. J. O'Grady, 2,814,463 to A. W. Kammerer, Jr., 3,196,961 to A. W. Kammerer, 3,552,509 to C. C. Brown, 3,554,304 to H. D. Link et al, 3,656,564 to C. C. Brown, 3,684,041 to A. W. Kammerer et al and 5,271,472 to R. E. Leturno.

There is a continuing demand and need for drill bit assemblies which are highly versatile as well as efficient and durable in use and specifically are conformable for use as a drill bit tool, mill section tool or combinations thereof and can be utilized, with or without fluid assist, with retrievable or stationary bits, with or without jet kerf cutting, with or without a pilot nose, and with or without tungsten carbide buttons, cutting teeth, cutting rollers or polycrystalline diamond inserts. Most desirably, the drill bit assembly of the present invention incorporates a unique combination and arrangement of cutters and fluid passages along one or more blade arms of a drill bit assembly; and which is further characterized by being easily and quickly retrievable and replaceable.

SUMMARY OF THE INVENTION

It is therefore an object of the present invention to provide for a novel and improved drill bit assembly which is highly versatile and conformable for use in performing various earth boring operations.

It is another object of the present invention to provide for a novel and improved method and means for mounting a drill bit assembly or other tooling at the lower end of a conventional drill string or casing string to carry out various downhole operations.

It is a further object of the present invention to provide for a novel and improved method and means for mounting drill bits and other tools at the lower end of a conventional drill or casing string wherein the tools are quickly retrievable and replaceable.

It is a further object of the present invention to provide for a novel and improved drill bit assembly which employs a unique combination of cutting inserts and fluid passages to carry out downhole cutting operations; and specifically wherein the cutting elements may be employed alone or in combination with fluid pressure to perform different cutting and kerfing operations.

It is a still further object of the present invention to provide for a novel and improved drill bit assembly in which cutting inserts are immovably positioned along a leading edge of the blade arm forming a part of each drill bit; and in an alternate but preferred form to provide for a series of rotatable cutter disks spaced along an undersurface of each blade arm to carry out cutting operations.

The present invention resides in a drill bit assembly to be lowered on a drill or casing string into a subsurface formation in which a sub is connected to a lower end of the drill string, and a drill bit has a pair of blades arranged in juxtaposed relation to one another including pivotal ends mounted in the sub about a common pivot member and blade arms extending tangentially from the pivotal ends between a position extending substantially in an axial direction downwardly from the sub and a cutting position extending in opposed perpendicular directions with respect to the rotational axis of the drill string, and the blade arms have a series of cutting elements along one edge thereof.

In one preferred form, the cutting elements are inserted in recesses along the entire length of each blade arm and include an arcuate surface portion which protrudes from an undersurface of the blade arm. In addition, the cutting elements have flat surface portions substantially flush with the leading edge of the blade arm. In a second preferred form, the cutting elements are in the form of cutter disks which are journaled about individual roller shafts on the undersurface of each blade arm, the axis of rotation of each cutter disk being such that the disk rotates along a line which is tangential to the radius of curvature of the drill bit at that location.

In either preferred form, each of the blades has a fluid passage extending at least along the length of the blade arm and a plurality of fluid discharge bores communicating with the fluid passage for discharge of fluid under pressure from the passage in the form of high velocity streams cutting into the formation. Most desirably, the discharge means extend transversely of the passage through an undersurface of each blade and is defined by nozzles extending through the blade behind the cutting element. For most efficient cutting and removal of the formation being drilled, the nozzle locations are staggered with respect to the cutting element location so that the cutting elements break up the material between the kerf lines formed by the nozzles. For example, if the nozzles are disposed only along one of the blades and the cutting elements disposed only along the other of the blades, the cutting elements will break up that formation material between the kerf lines formed by the nozzles on the one blade. If the cutting elements are positioned on both blades, they are preferably staggered with respect to one another so as to engage different radial distances in the formation between the kerf lines, and correspondingly if the nozzles are positioned along both blades should be offset with respect to one another to form kerf lines at different radial distances and thereby achieve enhanced cutting action. The number and spacing of cutting elements and nozzles will of course vary with the hardness of material being drilled, hole size and velocity of the fluid discharged.

From the foregoing, the method of drilling into a subsurface formation comprises the steps of discharging a high velocity stream of fluid through a plurality of nozzles in at least one of a pair of rotating blades whereby a series of kerf lines are formed in concentric circles, and placing a series of cutting elements on at least one other of the blades to break up the formation material between the kerf lines formed by the jet streams through the nozzles. Whether the nozzles and cutting elements are positioned along one or both blades, most desirably the cutting elements are offset with respect to the path of the nozzles so as to break up the formation between the kerf lines formed by the nozzles. When rotating cutter disks are employed as the cutting elements, the disks are oriented to follow or track the kerf lines formed by the nozzles to assist in breaking up the rock or other material between the kerf lines.

As an added feature of the present invention, the pivot member for the blades is removably seated in the sub and lift plates extend upwardly from the sub having a latching device which is engageable by a retrieval bar so as to effect latching engagement between the retrieval bar and latching member for the purpose of lifting the drill bit out of the hole for replacement.

There has been outlined the salient features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting. In this regard, the term "drill string" is employed herein to interchangeably refer to a rotating string of drill pipes or casings. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENT

Figure 1:
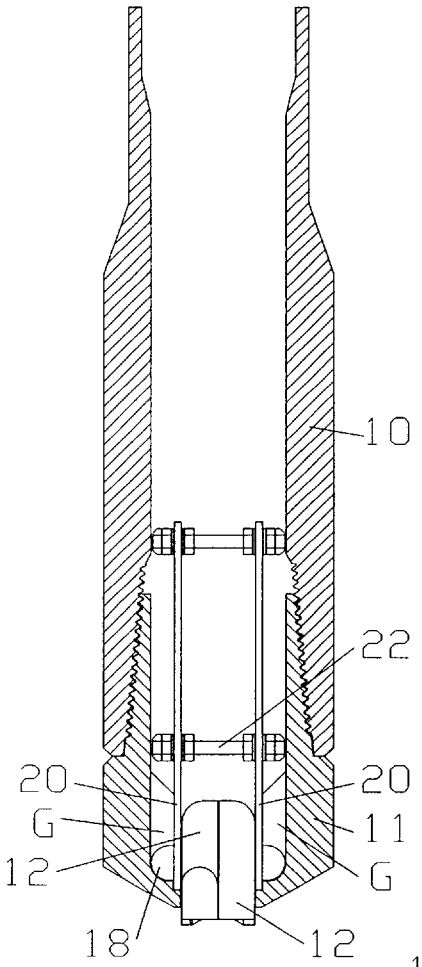
FIG. 1 is a view partially in section of a preferred form of drill bit assembly in accordance with the present invention with the drill bits shown in their operating position.
Figure 2:
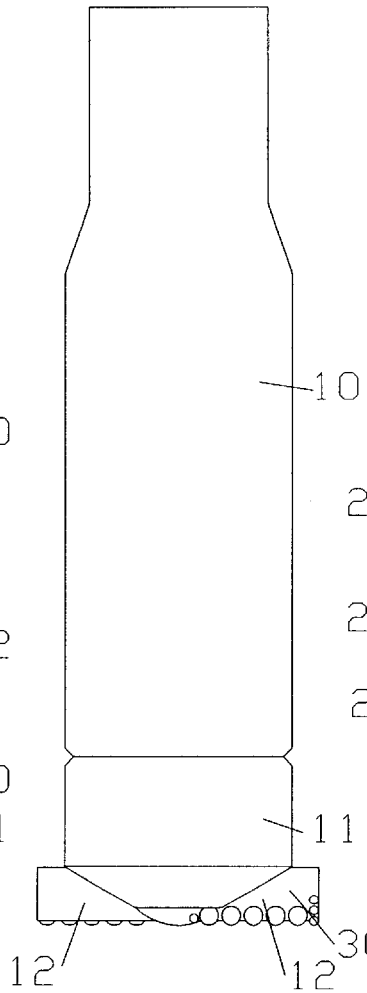
FIG. 2 is an elevational view of the assembly shown in FIG. 1.
Figure 3:
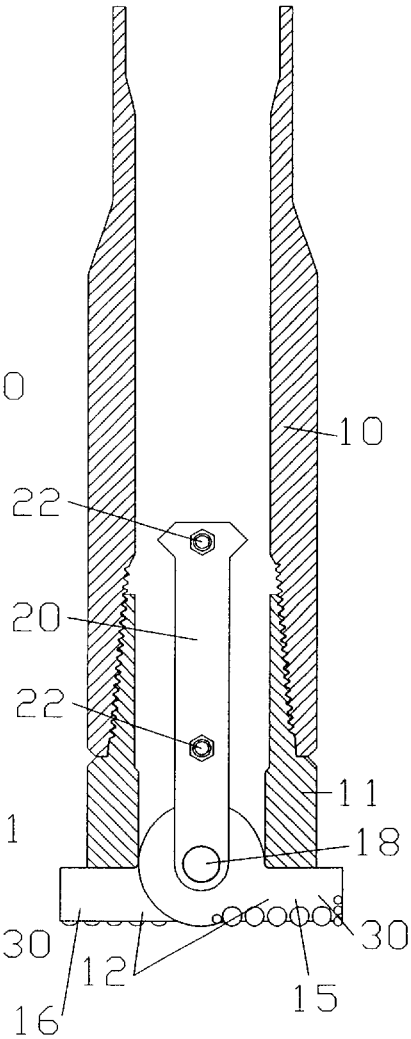
FIG. 3 is another view similar to FIG. 1 but illustrating the assembly at right angles to that shown in FIG. 1 and with the drill bits in their operating position.
Figure 6:
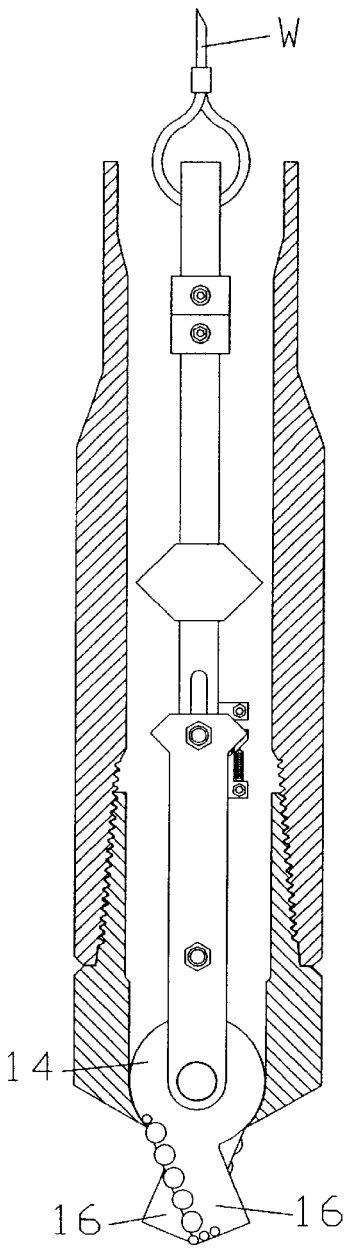
FIG. 6 is a view partially in section of the assembly illustrated in FIGS. 4 and 5 but taken at right angles to that of FIGS. 4 and 5.
Figure 7:
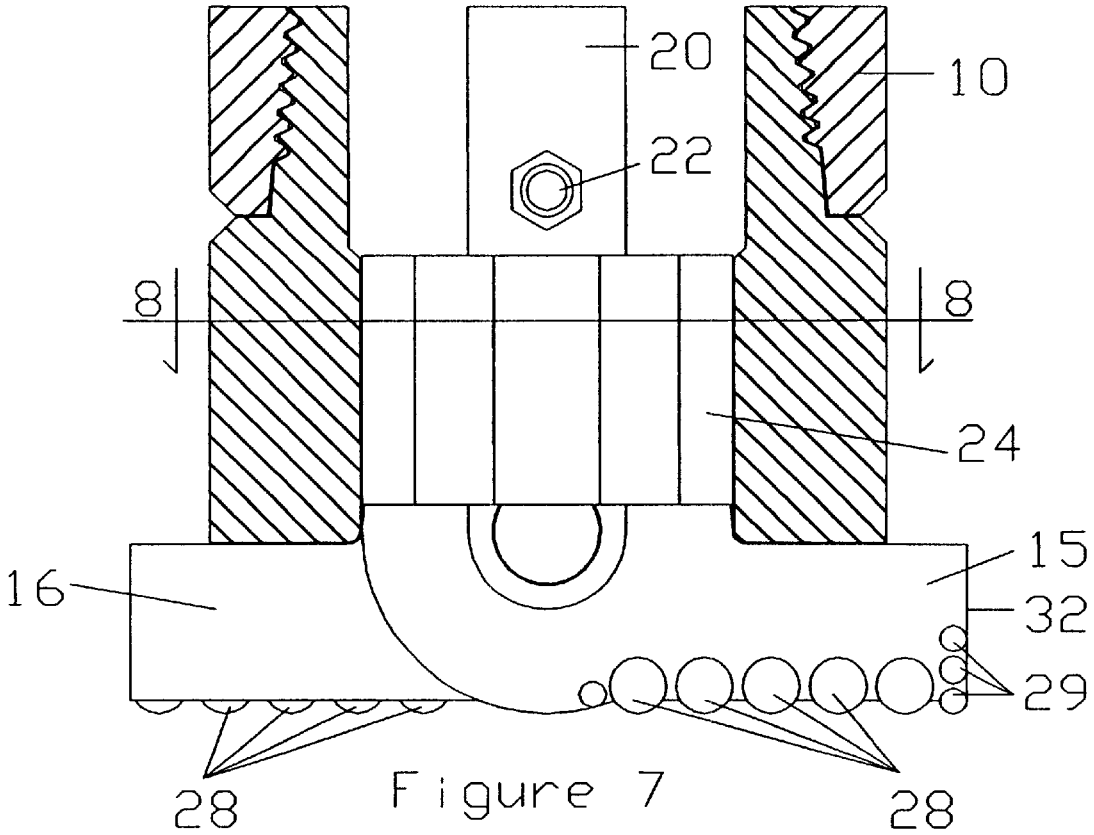
FIG. 7 is a cross-sectional view enlarged of the preferred form of drill bit assembly and seal employed therein.
Figure 8:
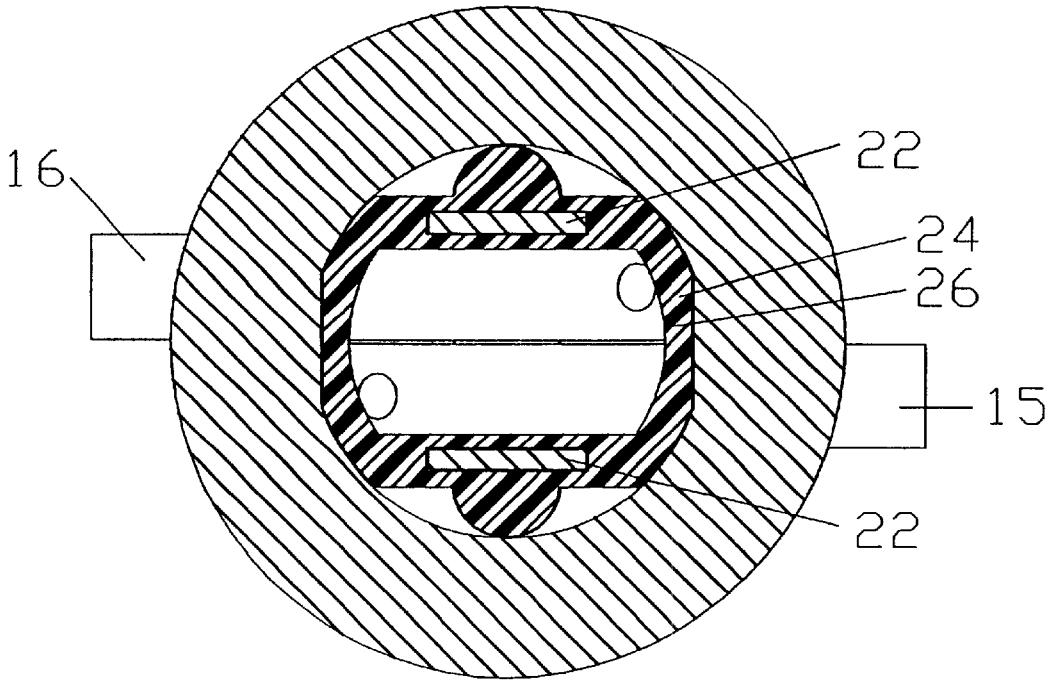
FIG. 8 is a cross-sectional view taken about lines 8—8 of FIG. 7.

Referring in more detail to the drawings, there is shown in FIGS. 1 to 3 a preferred form of invention in which a conventional drill pipe 10 is threadedly attached to a sub in the form of a seat coupling 11 for a pair of drill bits or blades 12. Each drill bit includes an upper rounded pivotal end or collar 14 and a blade arm 16, the collars 14 being journaled on a common pin 18 which extends transversely of the drill pipe 10 and supports the bits 12 for pivotal movement between a position extending substantially in a lengthwise direction of the drill pipe 10 when at rest and, when in operation, a transverse direction as illustrated in FIGS. 6 and 1, respectively. In this relation, the bits 12 are mounted on the pin 18 between a pair of lift plates 20 which extend upwardly from the pin 18, the plates 20 having vertically spaced lift plate bolts 22. Opposite ends of the pin 18 are slidable in grooves G in diametrically opposed sides of the coupling 11 and are shown seated at the lower ends of the grooves G. An annular seal 24, shown in detail in FIGS. 7 and 8, is positioned above the bits 12 with the lift plates 20 extending upwardly through slots 25 in the seal 24 so as to confine the flow of fluid through the central opening 26 of the seal into fluid passages in the bits 12 in a manner to be hereinafter described.

Figure 9:
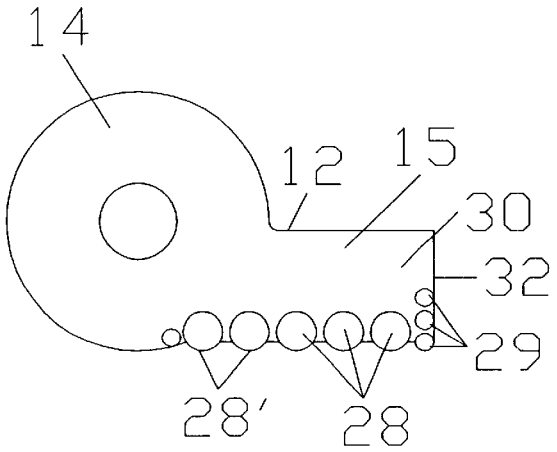
FIGS. 9 and 10 are enlarged views in detail of each of the drill bits employed in the drill bit assembly of the present invention.
Figure 10:
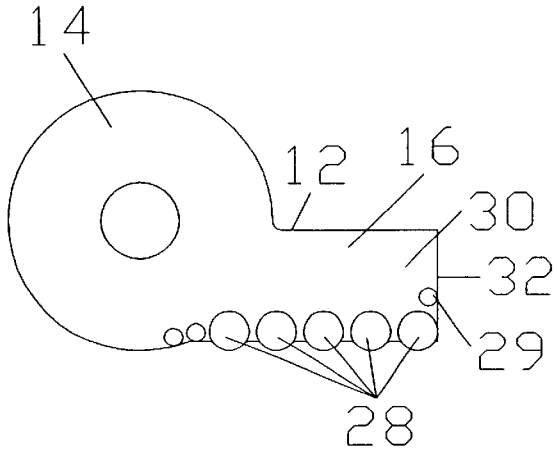

Considering in more detail the mounting and construction of the bits 12, as shown in FIGS. 9 to 15, each of the blade arms 15 and 16 extends tangentially away from the collar 14 and has inserts 28 of a hardened cutting material inserted in circular recesses along a leading edge 30 of each blade arm 15 and 16. The inserts 28 are in the form of cylindrical pins having their longitudinal axes extending perpendicular to the length of the arm 16. Further, the greater diameter of each insert 28 is inserted into the thickness of the arm so that only a limited arcuate surface 28' protrudes from the undersurfaces 31 of the arms 15 and 16. Additional inserts 29 extend transversely of the blade arm over a limited distance of the collar 14 as well as along a free terminal edge 32 of each blade arm 15 and 16, as illustrated in FIGS. 9 and 10. More specifically, FIGS. 9 and 10 illustrate the offset relationship between the inserts for the respective blade arms 15 and 16 as hereinafter described in more detail.

As shown in FIGS. 11 to 15, each of the blade arms 15 and 16 is preferably of generally rectangular cross-section and includes fluid passages made up of a first bore 34 which extends chordally through the collar 14 of the blade and a second bore 35 which extends substantially at right angles to the first bore 34 in a lengthwise direction throughout the full length of the blade arms 15 and 16 but at a gradual angle extending away from the inserts 28. A series of nozzles or jets 38 communicate with the bore 35 and extend transversely therefrom to pass through the thickness of the blade arms 15 and 16 and discharge fluid as a high velocity stream at spaced intervals along the undersurfaces 31 of the blade arms 15 and 16 immediately behind the inserts 28. Preferably, each nozzle or jet is in the form of a cylindrical body 39 provided with an inner tapered bore 40 which converges toward its discharge end, and the body is mounted within a discharge passage 41 by a suitable retainer ring 42. A plug 37 at the extreme outer or free end of the blade arm 16 may similarly be defined by one of the nozzles 38 as described or, if desired to completely plug off the discharge end of the bore 35 may insert the solid cylindrical plug 37 as shown.

Figure 15:
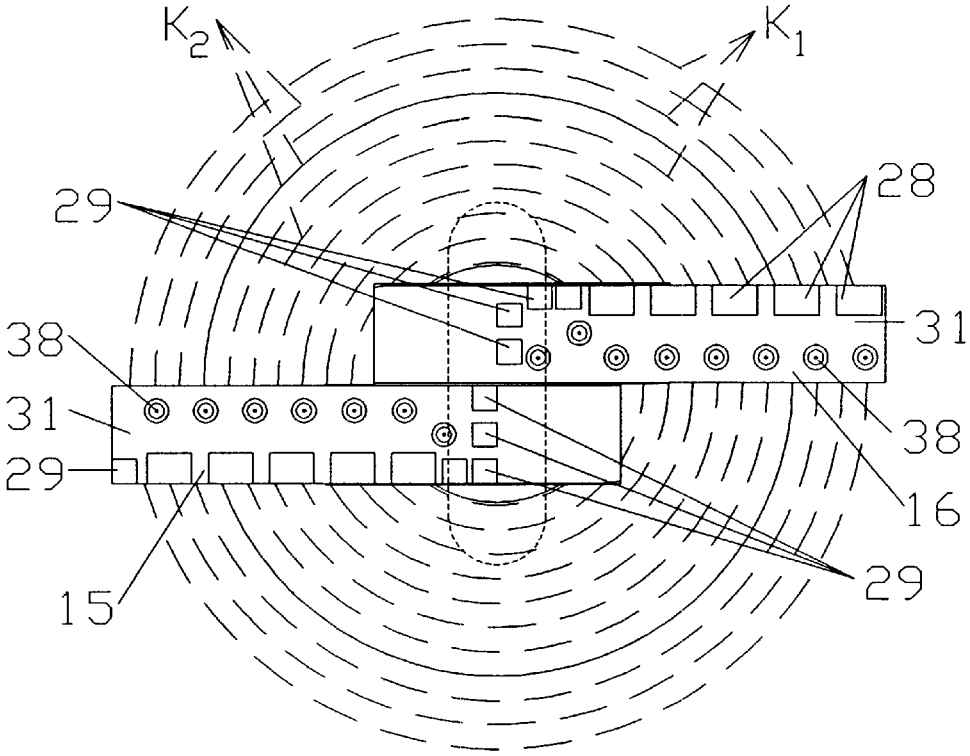
FIG. 15 is a bottom plan view of the one preferred form of drill bit assembly illustrated in FIGS. 9 to 14.

As best seen from FIG. 15 which illustrates the undersurfaces 31 of the drill bits 12, the inserts 28 on one blade arm are offset with respect to the inserts 28 on the other blade arm; and similarly, the jets 38 on the one blade arm 15 are offset or staggered with respect to the nozzles 38 on the other blade arm 16. It is the primary function of the nozzles to form the kerf lines as illustrated in dotted form in FIG. 15, and thus the nozzles 38 on one blade arm will form the kerf lines $K_1$, and the nozzles 38 on the other blade arm will form kerf lines $K_2$ between the kerf lines $K_1$. It is the primary function of the cutter inserts 28 to break up the rock between the kerf lines $K_1$ and $K_2$ and therefore are aligned between the nozzles of their respective blade arms or, in other words, to break up the rock between the kerf lines formed by the nozzles. Accordingly, as seen from FIG. 15, as viewed from the bottom of the well bore or underside of the drill bits 12, the cutting inserts or cutters 28 on the lefthand blade arm will traverse the rock or other material between the kerf lines $K_1$ formed by the jets 38 on the righthand blade 16, assuming that the blades are rotating in a clockwise direction as viewed from above the blades. Conversely, the cutters 28 on the righthand blade will traverse the rock or other formation material between the kerf lines $K_2$ formed by the jets 38 on the lefthand blade 15. Specifically, the cutting inserts 28 will operate to scrape or shear off the rock or formation material.

Figure 16:
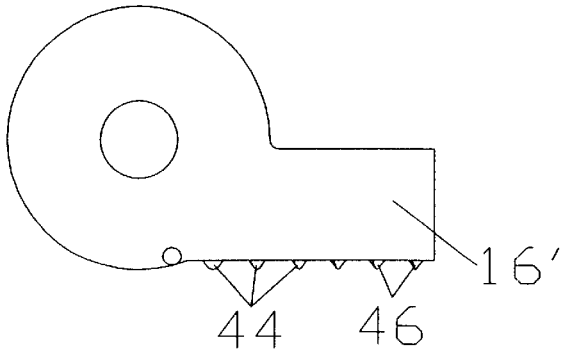
FIGS. 16 and 17 are enlarged views in elevation of each of the drill bits of a second preferred form of invention.
Figure 17:
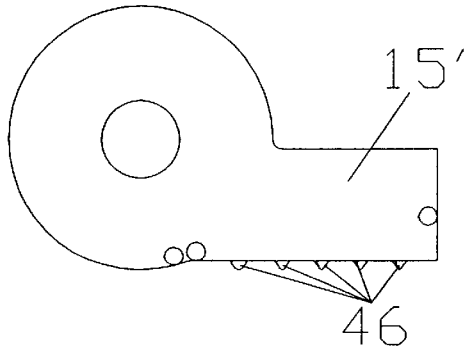
Figure 11:
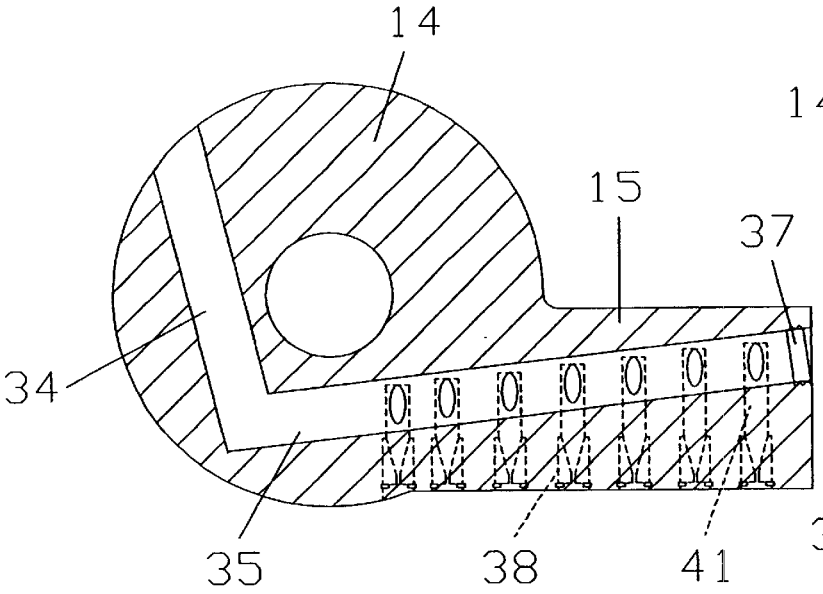
FIG. 11 is a cross-sectional view of the drill bit shown in FIG. 9 and illustrating the disposition of fluid passages in the drill bit.
Figure 12:
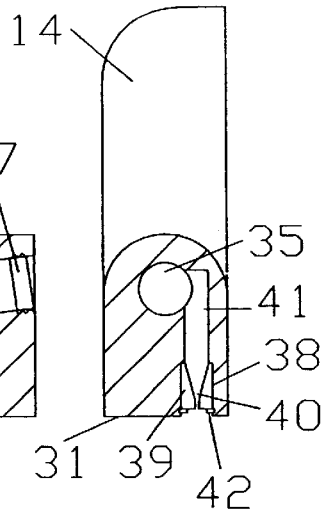
FIG. 12 is an end view partially in section of the drill bit shown in FIG. 11.
Figure 13:
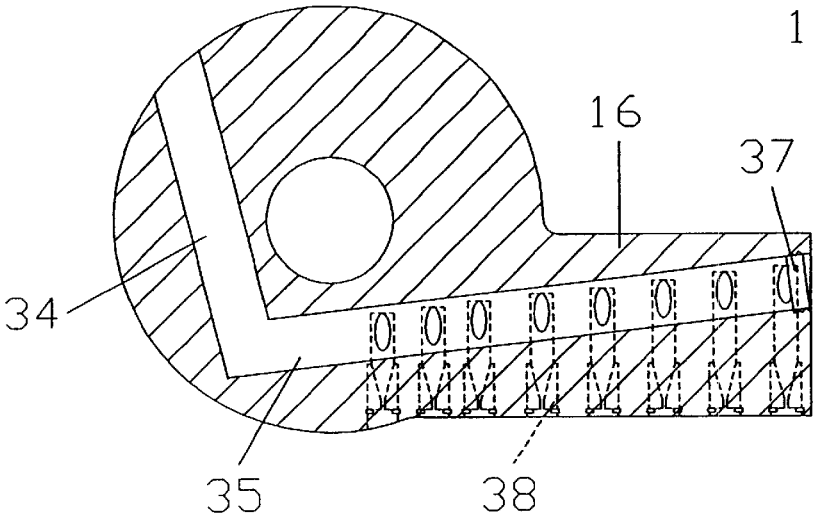
FIG. 13 is a cross-sectional view of the drill bit illustrated in FIG. 10.
Figure 14:
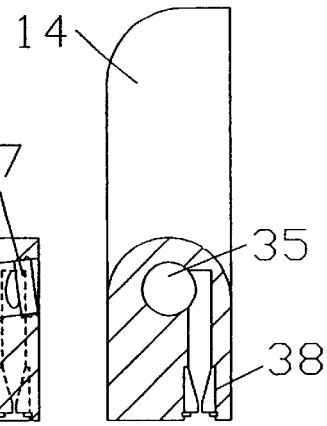
FIG. 14 is an end view partially in section of the drill bit illustrated in FIG. 13.
Figure 18:
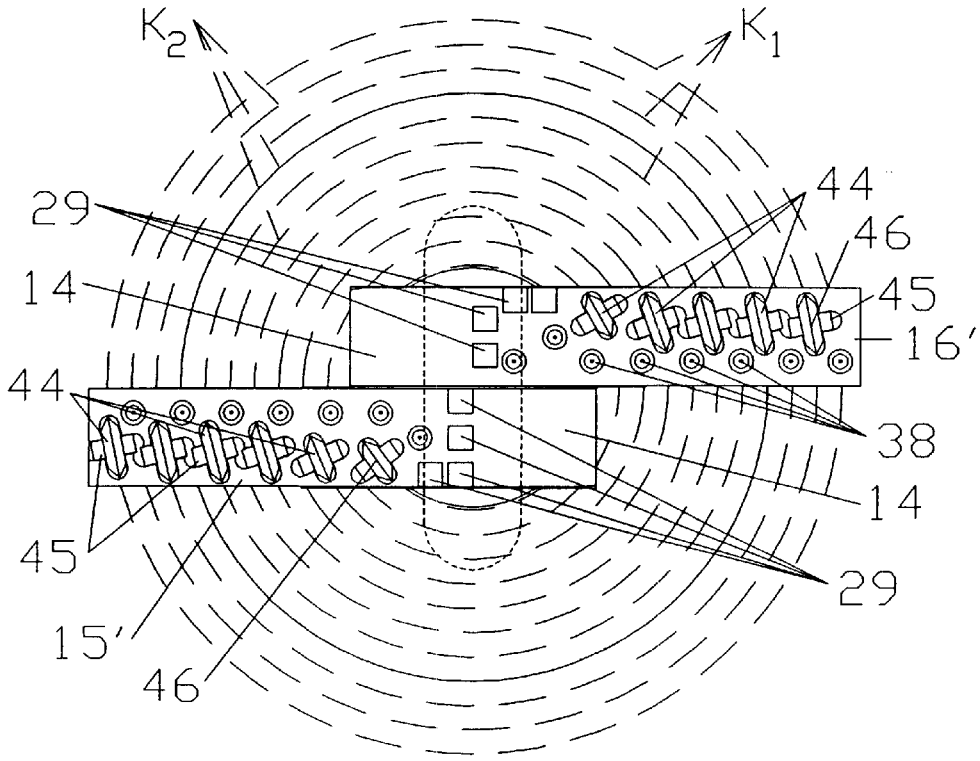
FIG. 18 is a bottom plan view of the second preferred form of drill bit assembly.

In the other preferred form of invention as shown in FIGS. 16 to 18, cutter disks 44 are mounted for rotation about individual roller shafts 45 which are affixed in recesses in the undersurface of the blade arms 15' and 16' immediately ahead of the nozzles or jets 38. As best seen from the bottom view, FIG. 18, the axis of rotation for each disk 44 is such as to correspond to the radius of curvature which that disk 44 follows or, in other words, the shaft 45 for each bearing is oriented to be perpendicular to the radius of curvature at that point on the undersurfaces of the blade arms 15' and 16'. The individual disks 44 are of a hardened material, such as, tungsten carbide or polycrystalline diamond material similar to that of the inserts 28 and have tapered surfaces which intersect or terminate in a cutting edge 46 which will follow the kerf line of the nozzle jet streams from the opposed blade at that particular point or radius as illustrated in FIG. 11. In addition, cutting inserts 29 corresponding to the inserts 29 shown in FIG. 15 may be positioned along the undersurface of the collar portion 14 of each drill bit 12. The fluid is expelled from the circulation channels under sufficient pressure to kerf and remove the cuttings or at least weaken it for ease of removal by the disks 44, after which the fluid and cuttings will move upwardly between the drill pipe 10 and face of the bore until expelled at the surface. It will be apparent that the term "fluid" as employed herein is intended to refer to any liquid, gas or mixture thereof which is customarily employed in earth boring or kerfing operations.

Figure 4:
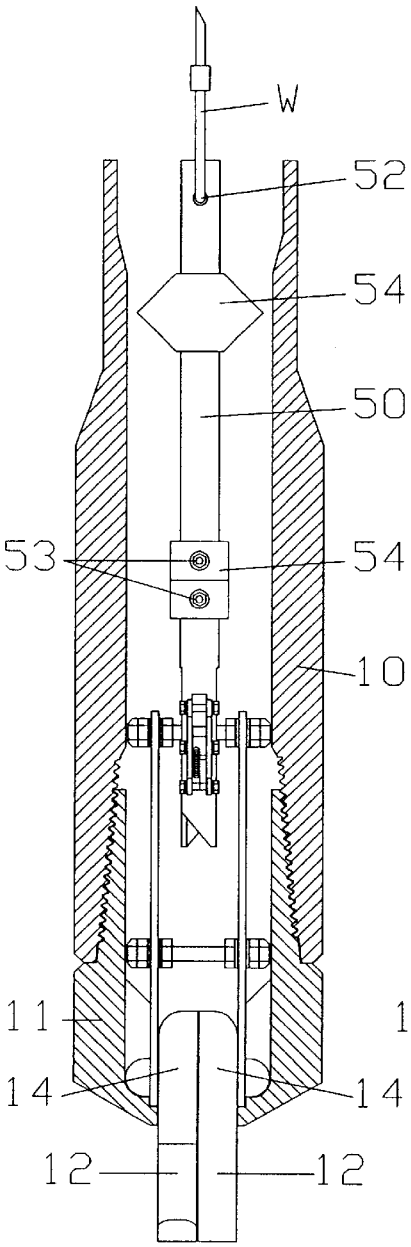
FIG. 4 is a view partially in section of the preferred form of drill bit assembly shown at rest in further combination with a preferred form of bit retrieval apparatus.
Figure 19:
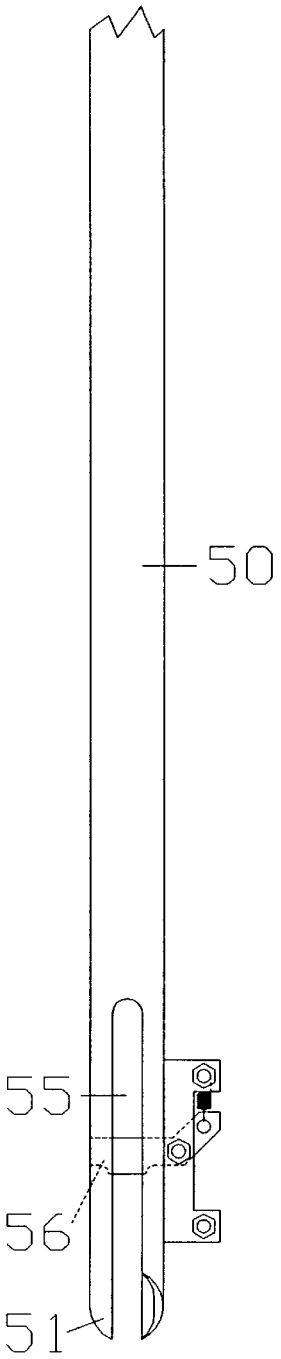
FIG. 19 is an elevational view of a portion of the retrieval apparatus shown with the latch member in a closed position.
Figure 20:
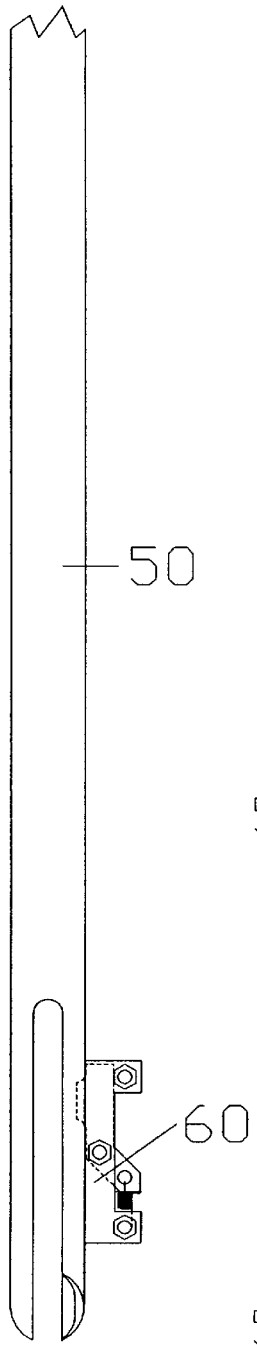
FIG. 20 is an elevational view of the apparatus shown in FIG. 19 with the latch member in the open position.
Figure 21:
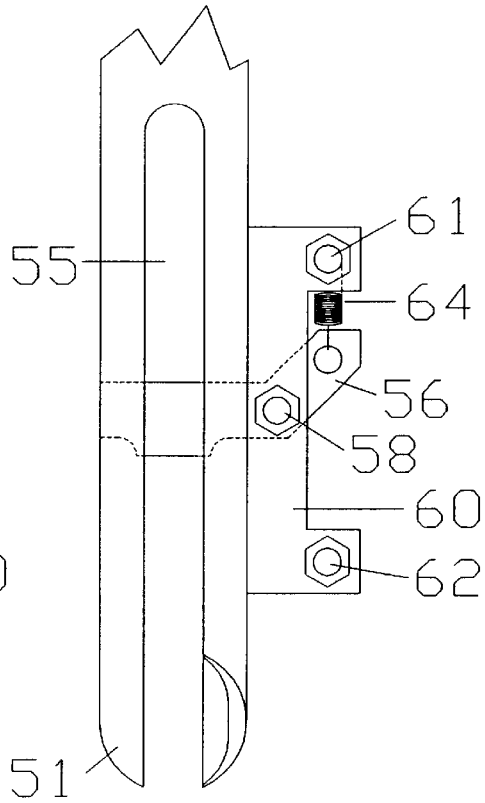
FIG. 21 is an enlarged fragmentary view of the latching device as shown in FIG. 19.

In order to retrieve and replace the bits 12, such as, when the bits 12 or their inserts 28 become dull or worn, they may be removed by a retrieval bar 50 which is attached to the lower end 52 of a wireline W extending from a conventional surface block and tackle, winch or similar device to run tools in and out of the hole. The retrieval bar 50 is suspended from the lower looped end of the wireline W and includes centralizers 54 attached at vertically spaced intervals by suitable fasteners, such as, bolts 53. A retrieval slot 55 at the lower end 51 of the bar 50 receives an upper one of the lift plate bolts 22, all as illustrated in FIGS. 4 and 6. As illustrated in more detail in FIGS. 19 to 21, a latch assembly is mounted at the lower beveled end of the retrieval bar 50 and comprises a latch 56 which is pivotally connected alongside the slot 55 by latch pin 58 in a support block 60 which is welded to the lower end of the retrieval bar 50. Anchor pins 61 and 62 are positioned at upper and lower ends of the support block 60 and a spring element 64 affixed to the latch 56 may be releasably attached to either one of the anchor pins 61 or 62. For example, when blades 12 are to be retrieved from the hole, the spring 64 is attached so as to springload the latch 56 in a direction extending across the slot 55 so that when the latch 55 is lowered against the upper lift plate bolt 22, the spring force will be overcome to pivot the latch upwardly until the bolt 22 clears the latch and the latch is then free to return to its original closed position. The wireline W is then lifted to pull the blades 12 out of the hole.

In lowering a new set of blades 12 into the hole, the spring 64 is released from the upper anchor 61 and attached to the lower anchor 62 so as to bias the latch 56 toward the open position away from the slot 55. The upper lift plate bolt 22 for the new set of blades is positioned in the slot 55 and the latch 56 manually pivoted back into the closed position and the blade assembly then lowered until the weight of the bolt 22 is bearing against the latch 22 and the new blades then lowered by wireline into the drill pipe 10 until seated in the seat coupling 11. Once the blade assembly is properly seated in the coupling 11, continued lowering of the latch assembly to remove the weight of the upper bolt 22 from the latch 56 will permit the latch 56 to be pivoted upwardly under the urging of the spring 64 into the open position and the retrieval bar 50 can then be removed from the hole.

In use, the drill bits 12 are assembled with the lift plates 20 on the pin or shaft 18 and placed in the seat coupling 11 which is then threadedly attached to the drill pipe 10. The lower lift plates 20 and pin are slidable through groove G in the seat coupling 11 until firmly seated in the lower end of the groove. The drill pipe 10 is then lowered into the formation to be bored and with rotational force applied to the drill pipe 10, the blade arms 12 are swung outwardly into the drilling position as shown in FIG. 3. Fluid is supplied under pressure into the circulation channels or bores 34 and 35 of the drill bits 12 and converted into high velocity jet streams by the nozzles 38. The delivery of fluid under a high degree of force through the blades 12 will cooperate in maintaining the blades in a perpendicular position with respect to the drill pipe. Further, under frictional force applied by the material to be bored, the blade arms 12 will be maintained in the perpendicular position as described. The fluid which is pumped through the jet channels or nozzles 38 will form the kerf lines $K_1$ and $K_2$ except in extremely hard rock materials. In certain formations, the jet force will be sufficient without additional cutting elements to kerf and remove the material to be bored, or at least weaken the material for ease of removal by the blades 12.

With the assistance of either form of the staggered or offset cutting elements 28 or 44 as described any remaining material is removed between the kerf lines, and the fluid will operate to carry any of the cuttings between the drill pipe 10 and face of the bore up to the surface.

Figure 5:
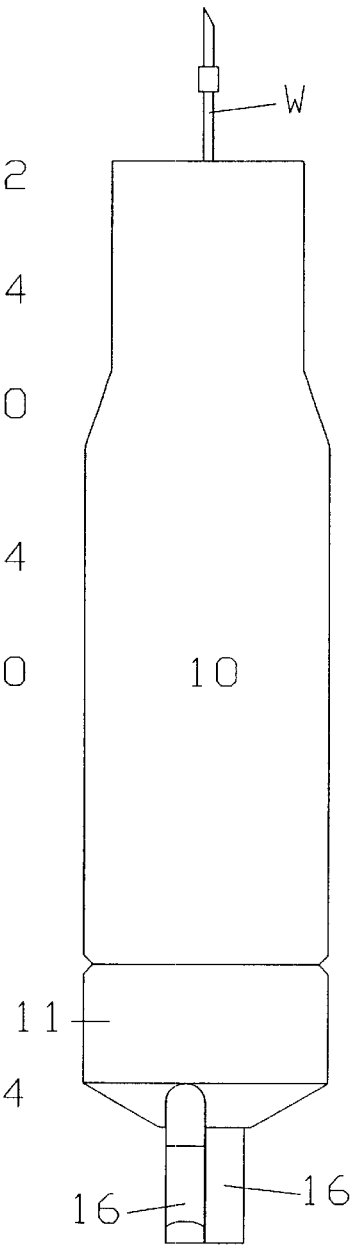
FIG. 5 is an elevational view of the assembly shown in FIG. 4 with the drill bits shown at rest.

When it is desired to retrieve the drill bits 12 resulting from becoming worn or broken or as a result of the nozzles 38 becoming enlarged and less effective, the retrieval apparatus is lowered by wireline W through the drill pipe 10 as illustrated in FIGS. 4 to 6. Centralizers 54 keep the retrieval bar 50 centered in the drill pipe 10 until the lower beveled end of the retrieval bar 50 contacts the upper lift plate bolt 22. Continued downward movement will cause the latch 55 to open until the bolt 22 clears the latch 55 and is returned to a closed position by the spring 64. The entire lift assembly is then drawn out of the seat coupling and lifted upwardly through the drill pipe by the wireline until completely removed from the drill pipe 10.

Once the drill bits 12 are replaced or refurbished, the spring 64 is then reversed and attached as described so as to cause the latch 55 to be in a normally open position. Once the upper lift plate bolt 22 for the new or refurbished drill bit assembly is positioned in the slot 55, the latch 56 is manually returned to the closed position and the bit assembly can then be lowered until seated in the seat coupling 11. Once the weight of the drill bit At assembly is removed from the latch 56, the spring 64 will open the latch to permit the wireline W and retrieval from the drill pipe so that boring can be resumed.

Milling and other operations as described can be carried out with the preferred forms of drill bit assemblies. In all wells, particularly those where the conventional changing of downhole tools is costly and time-consuming, or where varying different diameters of borehole are desired, the bit assemblies of the present invention are especially effective.

It is therefore to be understood that while preferred forms of invention are herein set forth and described, the above and other modifications and changes may be made without departing from the spirit and scope of the present invention as defined by the appended claims and reasonable equivalents thereof.

I claim:

1. In a drill bit assembly to be lowered on a drill string into a subsurface formation, the improvement comprising:

a sub connected to a lower end of said drill string; and a drill bit having a pair of blades arranged in juxtaposed relation to one another including pivotal ends mounted in said sub about a common pivot member, and blade arms extending outwardly from said pivotal ends between a position extending substantially in an axial direction downwardly from said sub and a cutting position extending substantially in a perpendicular direction with respect to the rotational axis of said drill string, said blade arms having a series of cutting elements along a cutting edge thereof; and means for imparting a centrifugal force to said blade arms to cause said blade arms to swing outwardly in a perpendicular direction with respect to the rotational axis of said drill string.

2. In an assembly according to claim 1, each of said cutting elements inserted in recesses along the substantial length of each said blade arms and along a free terminal edge of each of said blade arms.

3. In an assembly according to claim 2 wherein each of said cutting elements includes an arcuate surface portion protruding from an undersurface of said blade arm.

4. In an assembly according to claim 3 wherein each said blade arm is of generally rectangular cross-section and terminates in a squared end portion, at least one of said cutting elements being mounted in said squared portion.

5. In an assembly according to claim 1, said centrifugal force-imparting means including means for rotating said drill string, a fluid passage extending at least along the length of said blade arm, and a plurality of fluid discharge means communicating with said fluid passage for discharging fluid under pressure from said fluid passage outwardly from said blade arm.

6. In an assembly according to claim 5 wherein said discharge means extend transversely of said passage through an undersurface of said blade arm.

7. In an assembly according to claim 6 wherein said discharge means is in the form of nozzles extending through said blade arm adjacent to said cutting elements, said nozzles on each said blade arm being disposed in offset relation to said cutting elements, said cutting elements on one of said blade arms aligned to engage said formation between kerf lines formed by said nozzles.

8. In an assembly according to claim 1 wherein said pivot member is removably seated in said sub, lift plates extending upwardly from said sub having a latch release member at their upper ends, a retrieval bar including latch means at its lower end and arranged for downward extension through said drill string into latching engagement with said latch engaging member whereby to lift said drill bits out of said sub and through said drill string to the surface.

9. In an assembly according to claim 8 wherein said latch means includes a slot in a lower end portion of said bar, a pivotal latch member mounted for extension across said slot, and means for yieldingly urging said latch member between a latching position extending across said slot and a released position away from said slot.

10. In an assembly according to claim 9 wherein said urging means is reversibly mounted to selectively bias said latch either toward or away from said latching position.

11. In an assembly according to claim 1 wherein said cutting elements are defined by cutter disks journaled for rotation independently of said blade arm.

12. In a drill bit assembly to be lowered on a drill string into a subsurface formation, the improvement comprising:

a sub connected to a lower end of said drill string; and a drill bit having a pair of blades arranged in juxtaposed relation to one another including pivotal ends mounted in said sub about a common pivot member, and blade arms extending tangentially from said pivotal ends between a position extending substantially in an axial direction downwardly from said sub and a cutting position extending substantially in a perpendicular direction with respect to the rotational axis of said drill string, said blade arms having a series of cutting elements, said cutting elements each defined by a cutter disk journaled for rotation independently of said blade arm along a surface of said blade arm engaging said formation.

13. In an assembly according to claim 12, said cutting elements disposed along an undersurface of each said blade arm.

14. In an assembly according to claim 13, wherein each said cutting element has a cutter disk provided with a tapered cutting edge.

15. In an assembly according to claim 14 wherein each said blade arm is of generally rectangular cross-section and terminates in a squared end portion, said cutting elements being mounted in recesses in said blade arm.

16. In an assembly according to claim 12, each of said drill bits including a fluid passage extending at least along the length of said blade arm, and a plurality of discharge means communicating with said passage for discharging fluid under pressure from said passage outwardly from said blade arm.

17. In an assembly according to claim 16 wherein said discharge means extend transversely of said passage through an undersurface of said blade arm.

18. In an assembly according to claim 17 wherein said discharge means is in the form of nozzles extending through said blade arm between said cutting elements.

19. In an assembly according to claim 12 wherein said pivot member is removably seated in said sub, lift plates extending upwardly from said sub having a latch release member at their s upper ends, a retrieval bar including latch means at its lower end and arranged for downward extension through said drill string into latching engagement with said latch engaging member whereby to lift said drill bits out of said sub and through said drill string to the surface.

20. In an assembly according to claim 19 wherein said latch means includes a slot in a lower end portion of said bar, a pivotal latch member mounted for extension across said slot, and means for yieldingly urging said latch member between a latching position extending across said slot and a released position away from said slot.

21. In an assembly according to claim 20 wherein said urging means is reversibly mounted to selectively bias said latch either toward or away from said latching position.

22. In an assembly according to claim 18 wherein said nozzles on each said blade arm are disposed in offset relation to said cutting elements, said cutting elements on one of said blade arms aligned to engage said formation between or along kerf lines formed by said cutting elements on the other of said blade arms.

23. The method of drilling a subsurface formation comprising the steps of:

discharging high velocity streams of fluid through a plurality of nozzles in at least one of a pair of pivotal drill bits and rotating said drill bits to cause said bits to form a series of concentric circular kerf lines in the formation; and providing a series of cutting elements on at least another of said drill bits to break up any formation material between said kerf lines.

24. The method according to claim 23 wherein said cutting elements are offset with respect to said nozzles.

25. The method according to claim 23 wherein said nozzles and said cutting elements are disposed along formation-engaging surfaces of each of said drill bits.

26. The method according to claim 23 including the step of imparting a centrifugal force to said drill bits to cause said bits to swing outwardly into operating position and to maintain said drill bits in the operating position.

27. The method according to claim 25 wherein said cutting elements on one of said drill bits are offset with respect to said cutting elements on another of said drill bits.

28. The method according to claim 23 including the step of discharging said fluid through said nozzles under sufficient force to cause said drill bits to swing radially outwardly into operating position.

29. The method according to claim 23 including the step of maintaining said drill bits in the operating position by virtue of the frictional engagement between said drill bits and the material being bored.

* * * * *